United States Patent [19]

Tomoyori et al.

[11] Patent Number: 4,806,969

[45] Date of Patent: Feb. 21, 1989

[54] FIXING DEVICE

[75] Inventors: Makoto Tomoyori; Sunao Hatanaka, both of Iwate, Japan

[73] Assignee: Alps Electric Co., Ltd., Japan

[21] Appl. No.: 98,937

[22] Filed: Sep. 21, 1987

[30] Foreign Application Priority Data

Nov. 28, 1986 [JP] Japan ..... 61-181799[U]

[51] Int. Cl.[4] ..... G03G 15/20

[52] U.S. Cl. ..... 355/3 FU; 355/14 FU; 219/216

[58] Field of Search ..... 355/3 FU, 14 FU; 219/216

[56] References Cited

U.S. PATENT DOCUMENTS 4,526,459 7/1985 Bresnick ..... 355/3 FU 4,550,334 10/1985 Toshimitsu ..... 355/3 R

*Primary Examiner*—A. C. Prescott

*Attorney, Agent, or Firm*—Guy W. Shoup; Paul J. Winters; John F. Schipper

[57] ABSTRACT

A fixing device wherein a toner image on a paper sheet passing either of two paper paths can be fixed by means of a single heat roll. The fixing device comprises a single heat roll, a pair of pressure rolls for contacting under pressure with the heat roll, and a pair of paper passing means for individually passing a paper sheet to a pair of contact positions at which the heat roll normally contacts with the pressure rolls. By selectively passing a paper sheet having a toner image thereon to one of the contact positions with the toner image opposed to the heat roll, the toner image is fixed to the paper sheet by heat and mechanical pressure of the heat roll and the pressure rolls.

3 Claims, 3 Drawing Sheets

FIXING DEVICE

BACKGROUND OF THE INVENTION

This invention relates to a fixing device for fixing a toner image on a paper sheet to a surface of the paper sheet by heat and mechanical pressure, and more particularly to a fixing device suitable to fix toner images on a paper sheet to opposite surfaces of the paper sheet.

Generally in an apparatus such as an electrophotographic apparatus which prints a toner image on a paper sheet, a paper sheet having a toner image attached thereto is passed through a fixing device in order to fix the toner image to the surface of the paper sheet because otherwise if a toner image is attached to the paper sheet, mere rubbing of the surface of the paper sheet may take toner powder off the surface of the paper sheet, which will not allow practical use of the recorded material. Such a fixing device normally includes a heat roll which is heated to a high temperature by a heat source contained in the fixing device, and a pressure roll for contacting under pressure with the heat roll. Thus, when a paper sheet is passed between the heat roll and the pressure roll in such a manner that an unfixed toner image on a surface of the paper sheet may face the heat roll, the toner image is fixed to the surface of the paper sheet by heat and mechanical pressure of the rolls.

Where a fixing device is provided for each of two different paper paths formed in a printer such as a double-sided printer for printing on opposite surfaces of a paper sheet, conventionally a heat roll and a pressure roll are provided for each of the paper paths.

However, if a pair of rolls is provided for each of two paper paths in this manner, up to two fixing heat rolls are required for a printer. Because a heat roll itself is expensive compared with a pressure roll, employment of two heat rolls in a single printer will make the entire printer expensive.

SUMMARY OF THE INVENTION

It is an object of the present invention to provide a fixing device wherein a toner image on a paper sheet passing along either of two paper paths can be fixed by means of a single heat roll, eliminating the problem of the conventional drawback described above.

According to the present invention, there is provided a fixing device, comprising a single heat roll, a pair of pressure rolls for contacting under pressure with said heat roll at different circumferential positions of said heat roll, and a pair of paper passing means for individually passing a paper sheet to one of a pair of contact positions at which said heat roll normally contacts with said pressure rolls, whereby a toner image on a paper sheet is selectively passed to one of said contact positions in such a manner that the toner image faces the heat roll and is fixed by heat and mechanical pressure of said heat roll and one of said pressure rolls which normally contacts with said heat roll at this contact position.

In the fixing device of the present invention, a toner image on either of two opposite faces of a paper sheet can be firmly fixed to the paper sheet only by passing the paper sheet through a selected one of a pair of paths for fixing, which paths are each formed by the single heat roll and one of the two pressure rolls normally held in contact under pressure with the heat roll.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
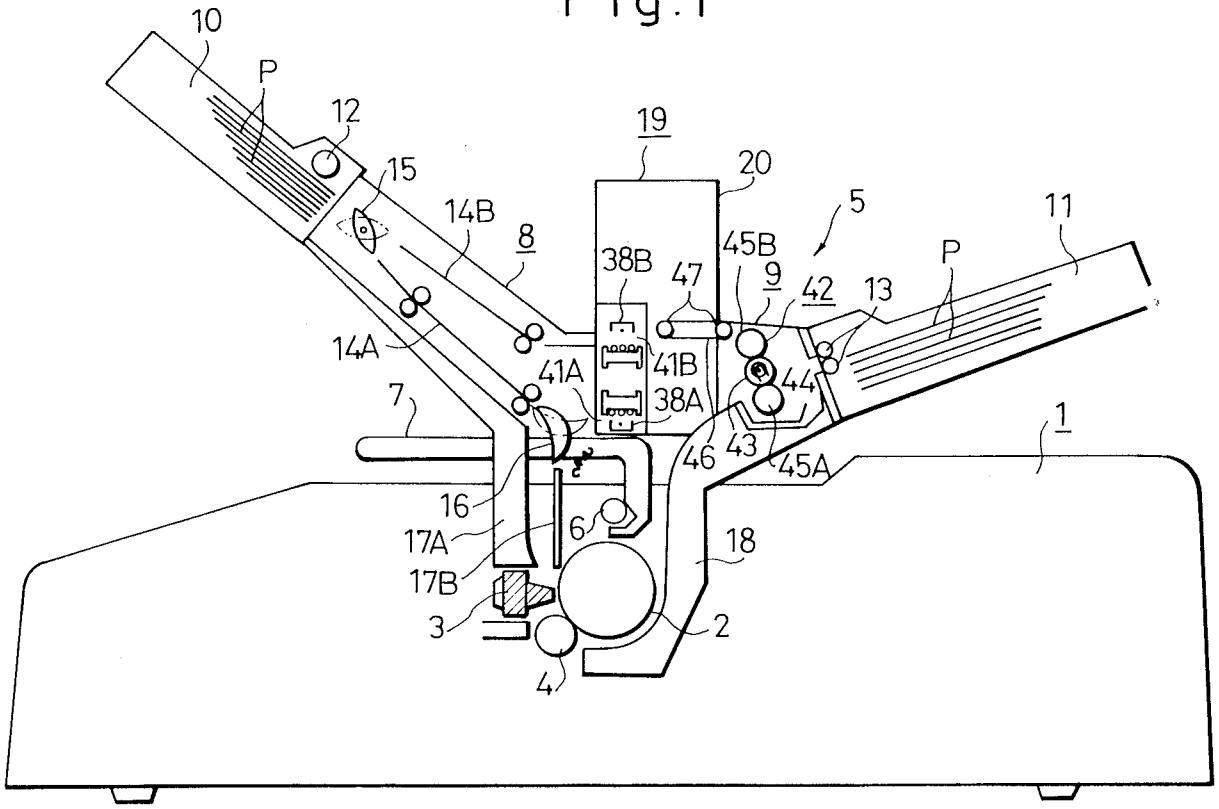
FIG. 1 is a front elevational view, partly in vertical section, of an embodiment of a double-sided printer to which a fixing device according to the present invention is applied.

Referring first to FIG. 1, which shows a double-sided printer to which a fixing device according to the present invention is applied, the printer shown includes a printer body 1, a platen 2 located in the printer body 1, and a print head 3 such as a dot wire print head or a thermal head located in an opposing relationship to the platen 2 in the printer body 1. A transport roller 4 is in contact under pressure with the platen 2 and transports one after another of paper sheets to a print position between the platen 2 and the print head 3.

A paper transport device 5 is located above and mounted on the printer body 1 by means of an L-shaped securing member 7 which engages with a support shaft 6 located in the printer body 1 under an urging force of a spring. The paper transport device 5 has a paper supply section 8 and a paper discharging section 9 arranged in respective inclined positions such that those ends of the sections 8 and 9 adjacent to the platen 2 may be located at lower positions than the other ends. A supply paper tray 10 is formed at an upper end portion of the paper supply section 8 while a discharge paper tray 11 is formed at an upper end portion of the paper discharging station 9. A paper supply roller 12 is located in the supply paper tray 10 and delivers paper sheets P stored in a pile in the supply paper tray 10 one after another from the top of the pile of the paper sheets P. Meanwhile, a pair of bidirectionally rotatable transport rollers 13 are located in close contact with each other in the discharge paper tray 11 so that they may introduce a paper sheet P into or out of the discharge paper tray 11.

The paper supply section 8 has a pair of paper paths 14A, 14B formed in a vertically spaced relationship therein for transporting a paper sheet P forwarded from the supply paper tray 10, and further pairs of transport rollers 13, are located in the paper paths 14A, 14B. A change-over pawl 15 for selecting one of the paper paths 14A, 14B is mounted for pivotal motion at a portion of the paper supply section 8 forwardly of the supply paper tray 10. Another change-over pawl 16 is mounted for pivotal motion at a lower end portion of the paper supply section 8 for selecting whether a paper sheet P introduced into the paper path 14A should subsequently be either transported directly toward the paper discharging section 9 or else directed to a position between the platen 2 and the print head 3 in the printer body 1. Further, a pair of guide members 17A, 17B for introducing a paper sheet P within the paper supply station 8 to a position between the platen 2 and the print head 3 are provided on and extend vertically from the paper transport device 5 below the change-over pawl 16. Another guide member 18 for introducing a paper sheet P passing between the platen 2 and the print head 3 to the paper discharging section 9 is also provided on and extends vertically from the paper transport device 5.

Figure 2:
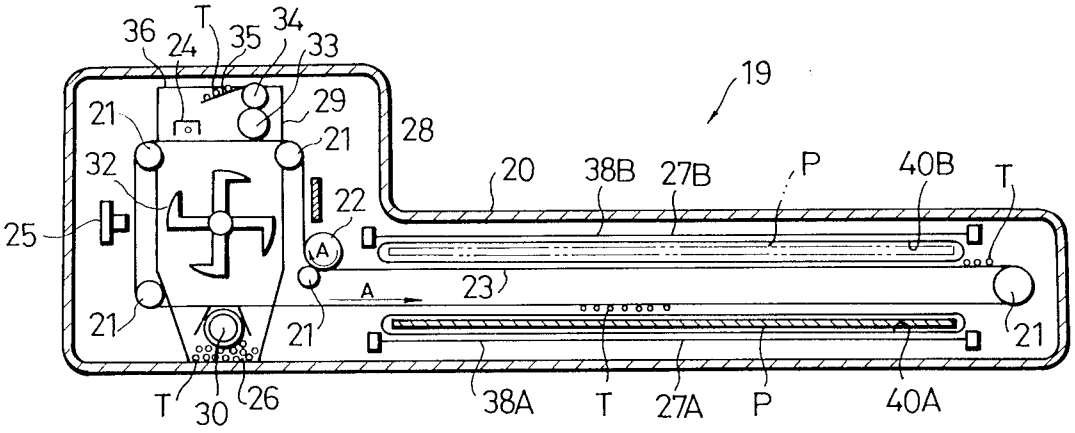
FIG. 2 is an enlarged vertical sectional side elevational view of an electrophotographic processing unit of FIG. 1.
Figure 3:
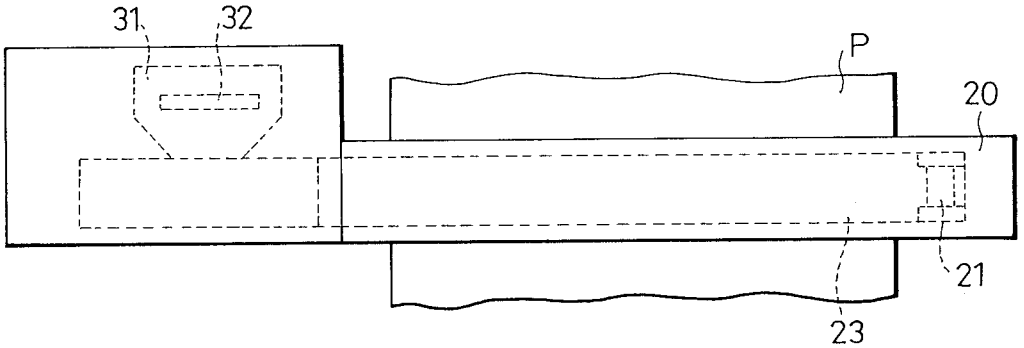
FIGS. 3 and 4 are a plan view and a front elevational view, respectively, of the electrophotographic processing unit of FIG. 2.
Figure 4:
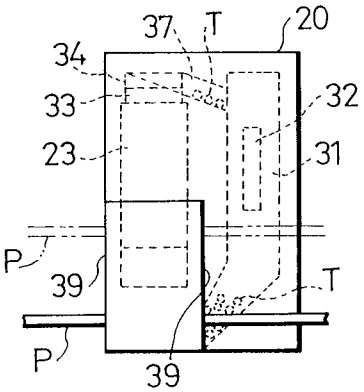

An electrophotographic processing unit 19, as an example of developing unit is located between the paper supply section 8 and the paper discharging section 9 of the paper transport device 5. Referring now to FIGS. 2 to 4, the electrophotographic processing unit 19 includes a casing 20 made of a synthetic resin material, and various devices and mechanisms necessary for electrophotographic processing except a fixing device are contained within the casing 20. In particular, an endless OPC (organic photo conductor) belt 23 is located within the casing 20 and supported at widthwise opposite marginal portions (non-print receiving portions) thereof by means of a plurality of guide rollers 21. The OPC belt 23 is driven to circulate in a direction indicated by an arrow mark A in FIG. 2 by a driving roller 22. The OPC belt 23 has a width sufficient to allow a picture image for a print line to be formed on the OPC belt 23. Located outside the OPC belt 23 within the casing 20 are, as listed in the direction of the arrow mark A, a charger 24 for uniformly charging the OPC belt 23, an LED (light emitting diode) head 25 for forming an electrostatic latent image on the OPC belt 23 charged uniformly by the charger 24 in accordance with information of a print pattern supplied from a controller not shown, a developing unit 26 for depositing toner powder T onto the OPC belt 23 to develop the electrostatic latent image formed on the OPC belt 23, first and second transfer stations 27A and 27B for transferring the toner image on the OPC belt 23 to a paper sheet P, a discharger 28 for removing the remaining potential on the OPC belt 23, and a cleaner 29 for removing the toner T remaining on the OPC belt 23.

The LED head 25 includes a plurality of light emitting elements or diodes arranged in a row in a direction perpendicular to the direction of circulation of the OPC belt 23. Meanwhile, the developing unit 26 includes a developing roller 30 which is rotated to carry toner powder T from therebelow to the OPC belt 23 thereabove and attach the toner powder T to the OPC belt 23. The developing unit 26 is supplied with toner powder T from a hopper (FIG. 4) 31 located behind the OPC belt 23, and an agitator 32 is located within the hopper 31. A cleaner 29 includes a sponge roll 33 mounted in contact with the OPC belt 23, a magnet roll 34 for attracting toner powder T attached to the sponge roll 33, and a blade 35 for taking off toner powder T attracted to the magnet roll 34. Toner powder T taken off by the blade 35 drops into the hopper 31 via an inclined communicating path 37 communicating the casing 36 of the cleaner 29 with the hopper 31 and is then agitated together with new toner powder T by the agitator 32.

The first transfer station 27A is provided to attach a toner image to an upper face of a paper sheet P, and to this end, the station includes a transfer device 38A located in an opposing relationship to and below a lower span of the OPC belt 23 within the casing 20. A paper path 41A (FIG. 1) is formed between the transfer device 38A and the lower span of the OPC belt 23 such that a paper sheet P introduced thereinto via one of a pair of horizontally extending slits 40A formed in opposite side walls 39 of the casing 20 may pass therethrough. Meanwhile, the second transfer station 27B is provided to attach a toner image to a lower surface of a paper sheet P, and to this end, it includes a transfer device 38B located in an opposing relationship to and above an upper span of the OPC belt 23 within the casing 20. Also to the end described above, another paper path 41B (FIG. 1) is formed between the transfer device 38B and the upper span of the OPC belt 23 such that a paper sheet P introduced thereinto via one of another pair of horizontally extending slits 40B formed in the side walls 39 of the casing 20 may pass therethrough. It is to be noted that, as seen in FIG. 1, the paper path 41A is located on an extension line of the paper path 14A while the paper path 41B is located on an extension line of the paper path 14B.

Figure 5:
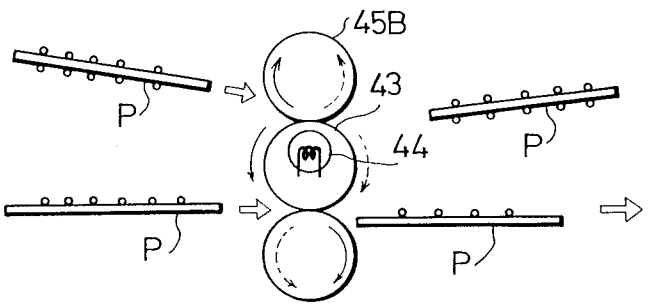
FIG. 5 is a schematic illustration showing detailed construction of the fixing device according to the present invention.

Referring back to FIG. 1, a fixing device 42 according to the present invention is located in the paper discharging section 9 for fixing toner powder T on a paper sheet P discharged from the electrophotographic processing unit 19 to the surface of the paper sheet P. The fixing device 42 includes, as shown in detail in FIG. 5, up to three rolls, namely, a heat roll 43 which can be heated to a high temperature by a heat source 44 contained therein, a pressure roll 45A for contacting under pressure with the heat roll 43 from below, and another pressure roll 45B for contacting under pressure with the heat roll 43 from above. Thus, a paper sheet P fed in from an opposing one of the slits 40A (FIG. 2) of the electrophotographic processing unit 19 is put between the heat roll 43 and the pressure roll 45A so that toner powder T is fixed to the upper surface of the paper sheet P by heat and mechanical pressure of the rolls 43, 45A. Meanwhile, a paper sheet P fed in from an opposing one of the slits 40B of the electrophotographic processing unit 19 is put between the heat roll 43 and the pressure roll 45B so that toner powder T is fixed to the lower surface of the paper sheet P by heat and mechanical pressure of the rolls 43, 45B. It is to be noted that the rolls 43, 45A and 45B are positioned and dimensioned such that a paper sheet P which has passed from the left to the right in FIG. 1 between the heat roll 43 and the pressure roll 45A or between the heat roll 43 and the pressure roll 45B may reach a position between the transport rollers 13 of the discharge paper tray 11. It is also to be noted that each "o" adjacent to a paper sheet P in FIG. 5 illustratively represents an unfixed toner particle and "o" represents a fixed toner particle.

A belt 46 for introducing a paper sheet P introduced through the opposing slit 40B of the electrophotographic processing unit 19 to a position between the heat roll 43 and the pressure roll 45B is located at a portion of the paper discharging section 9 between the electrophotographic processing unit 19 and the fixing device 42 and extends between a pair of pulleys 47 in FIG. 1. The belt 46 has a large number of small holes (not shown) formed therein so that a paper sheet P while being transported by the belt 46 may be attracted to the belt 46 by vacuum means not shown located inside the belt 46.

Now, operation of the printer of the embodiment described above will be described.

At first, when printing is to be performed by the print head 3 within the printer body 1, the change-over pawl 15 is positioned to a position as indicated by a solid line in FIG. 1 so that a paper sheet P from the supply paper tray 10 may be introduced into the lower paper path 14A, and the other change-over pawl 16 is similarly positioned to a position as indicated by a solid line so that a paper sheet P from the paper path 14A may be introduced into the printer body 1. Then, the paper supply roller 12 is driven to rotate to introduce an uppermost one of paper sheets P within the supply paper tray 10 into the paper path 14A, and the transport rollers 13 in the paper path 14A are driven to rotate to transport the paper sheet P until it is positioned at the print position between the platen 2 and the print head 3 within the printer body 1. Then, printing by the print head 3 and intermittent transportation of the paper sheet P are repeated to effect intended printing. After completion of the intended printing, the paper sheet P is passed between the heat roll 43 and the pressure roll 45A of the fixing device 42 and discharged onto the discharge paper tray 11.

On the other hand, when printing of a toner image on one surface of a paper sheet is to be effected, at first the change-over pawl 15 is positioned to the solid line position indicated in FIG. 1, as in the printing by the print head 3 described above, but the other change-over pawl 16 is now positioned at the other position indicated in lighter line in FIG. 1 so that a paper sheet P from the paper path 14A may be introduced into the opposing slit 40A of the electrophotographic processing unit 19. Then, the paper supply roller 12 is driven to rotate to introduce an uppermost one of paper sheets P within the supply paper tray 10 into the paper path 14A, and the transport rollers 13 are driven to rotate to forward the paper sheet P into the electrophotographic processing unit 19 via the opposing slit 40A of the electrophotographic processing unit 19 until it is stopped by a stopper (not shown) when the paper sheet P arrives at a position in which a portion of the paper sheet P at which it is to be printed opposite to the OPC belt 23 within the casing 20. In this condition, the OPC belt 23 of the electrophotographic processing unit 19 is driven to circulate in the direction of the arrow mark A in FIG. 2. Consequently, the OPC belt 23 is charged by the charger 24, and then an electrostatic latent image is formed on the thus charged OPC belt 23 by the LED head 25 in accordance with print pattern information supplied from the controller (not shown). Subsequently, toner powder is attached to the electrostatic latent image by the developing unit 26 to form a toner image for a print line on the OPC belt 23. When the toner image on the OPC belt 23 arrives at the first transfer station 27A, the transfer device 38A is energized to transfer the toner image on the OPC belt 23 to an upper surface of the paper sheet P. After transfer of toner powder T of the toner image, the OPC belt 23 is caused to discharge the remaining potential therefrom by the discharger 28, and then the remaining toner powder T is removed from the OPC belt 23 by the cleaner 29, whereafter the OPC belt 23 returns to its initial position. After formation of the toner image for a print line on the paper sheet P in this manner, the transfer rollers 13 are driven again to transport the paper sheet P by one line space distance, and another toner image is formed on the OPC belt 23 and transferred to the upper surface of the paper sheet P in a similar process as described above. As such a sequence of printing of a print line by the electrophotographic processing and intermittent transportation of the paper sheet P is repeated, the paper sheet P gradually approaches the fixing device 42 and finally is put between the heat roll 43 and the pressure roll 45A of the fixing device 42, which are rotating in directions indicated by the solid line arrow marks shown in FIG. 5. Consequently, as the paper sheet P is further transported intermittently, the toner powder T on the upper surface of the paper sheet P is fixed line by line to the upper surface of the paper sheet P by heat and mechanical pressure of the heat roll 43 and the pressure roll 45A. Such intermittent transportation of the paper sheet P is continued until completion of the intended printing on the paper sheet P by the electrophotographic processing unit 19; and after completion of the intended printing, the heat roll 43 and the pressure roll 45A are continuously rotated to discharge the printed paper sheet P onto the discharge paper tray 11 (FIG. 1) rotation of the transport rollers 13 of the discharge paper tray 11.

Further, when printing of toner images on opposite surfaces of a paper sheet is to be performed, an uppermost one of paper sheets P within the supply paper tray 10 is introduced into the paper path 14A in order to transfer a toner image to an upper surface of the paper sheet P by the electrophotographic processing unit 19 in a similar manner as in the single-sided printing of a toner image as described hereinabove. Then, when a rear or trailing end of the paper sheet P comes to the position between the heat roll 43 and the pressure roll 45A of the fixing device 42, completing fixing of all the toner powder T to the upper surface of the paper sheet P, the rear end of the paper sheet P is detected by a sensor (not shown), and in response to a signal from the sensor, the rolls 43, 45A, the transport rollers 13 and the paper supply roller 12 are now rotated in the reverse direction. As a result, the paper sheet P, part of which has reached within the discharge paper tray 11, is now transported from the right to the left in FIG. 1, passing through the electrophotographic processing unit 19, until it comes back into the supply paper tray 10 via the lower paper path 14A. After the paper sheet P has been redeposited in the supply paper tray 10, the change-over pawl 15 is changed over to the other position indicated in phantom in FIG. 1 so that a paper sheet P from the supply paper tray 10 may be introduced into the upper paper path 14B. Then, the paper supply roller 12 is driven to rotate forwardly to introduce the paper sheet P which has been already printed on the upper surface thereof from within the supply paper tray 10 into the paper path 14B, and the transport rollers 13 are driven to rotate forwardly to transport the paper sheet P into the electrophotographic processing unit 19 via the opposing slit 40B of the electrophotographic processing unit 19 until the sheet P is stopped at a predetermined position similarly by a stopper not shown. At this position, printing on a lower surface of the paper sheet for a print line is effected in the second transfer station 27B by similar electrophotographic processing as in the single-sided printing described hereinabove. After then, the paper sheet P is transported intermittently by one line space distance, and printing of a next print line is effected. As such a sequence of printing of a print line and intermittent transportation of the paper sheet P is repeated to progress printing, the paper sheet P is transported in the rightward direction while being attracted to the belt 46 by the attracting means not shown and finally is put between the heat roll 43 and the pressure roll 45B of the fixing device 42 which are then rotating in directions of broken line arrow marks shown in FIG. 5. Consequently, as the paper sheet P is further transported intermittently, the toner powder T on the lower surface of the paper sheet P is fixed line by line to the lower surface of the paper sheet P. Then, after completion of intended printing on the lower surface of the paper sheet P by the electrophotographic processing unit 19, the heat roll 43 and the transport rollers 13 of the discharge paper tray 11 are continuously rotated to discharge the paper sheet P which has now been printed on the upper and lower faces thereof, onto the discharge paper tray 11.

In this manner, according to the present embodiment, the fixing device 42 can be produced at a low cost because it includes only one heat roll 43 which itself is expensive while toner powder T on a paper sheet from either of the two paper paths 14A, 14B can be fixed at either of two different positions by the fixing device 42. Further, according to the present embodiment, it is possible to introduce a paper sheet P into the printer body 1 in order to effect impact printing with the print head 3 as well as to pass a paper sheet P through the electrophotographic processing unit 19 in order to effect non-impact printing with the electrophotographic processing unit 19. Accordingly, advantages of both printing methods can be utilized. Because double-sided printing can be effected by passing a paper sheet P successively through the two transfer stations 27A and 27B of the electrophotographic processing unit 19, use of a reversing path which requires a complicated structure can be eliminated.

It is to be noted that, while in the embodiment described above the developing unit is described as electrophotographic processing unit 19, a toner image may be formed by an electrostatic method or else by a magnetic method. Where the electrostatic method is employed to form an electrostatic latent image, the belt serving as a latent image forming means may be an electrostatic belt and an electrostatic latent image may be formed on the electrostatic belt by means of a multi-stylus electrode head. Where a toner image is to be formed by the magnetic method, the belt may be a magnetic belt and an electrostatic latent image may be formed on the magnetic belt by means of a magnetic head.

As apparent from the foregoing description, a fixing device according to the present invention can produce one-sided or two-sided printing at low cost due to its simplified structure; a toner image on a paper sheet can be fixed by a single heat roll while the paper sheet is passed along either of two paper paths.

It will be apparent to one of ordinary skill in the art that may changes and modifications can be made thereto without departing from the spirit and scope of the invention as set forth herein.

What is claimed is:

1. Image fixing apparatus for electrophotographic or magnetic printing on a sheet of print-receiving material that has two opposing sides that are adapted to receive images thereon, the apparatus comprising:

a heat roll, having a longitudinal axis about which the heat roll rotates, and having a source of heat that is sufficient to fix an image on a portion of one surface of a sheet of print-receiving material that is in contact with the heat roll;

a first rotatable pressure roll, positioned to contact the heat roll along a line of contact that is substantially parallel to the longitudinal axis of the heat roll;

a second rotatable pressure roll, positioned to contact the heat roll along a second line of contact that is substantially parallel to the longitudinal axis of the heat roll;

first image transfer means, positioned to transfer an image to a surface of a sheet of print-receiving material;

storage means to receive a sheet from the first image transfer means;

first sheet transport means to transport a sheet of print-receiving material to the first image transfer means, then to transport the sheet to a position between the heat roll and the first pressure roll, then to transport the sheet to the storage means;

second image transfer means, positioned to transfer an image to a surface of a sheet of print-receiving material; and second sheet transport means to transport a sheet of print-receiving material from the storage means to the second image transfer means, then to transport a sheet to a position between the heat roll and the second pressure roll, where the second image transfer means the the second transport means are positioned so that the second image transfer means transfers an image to a surface of the sheet that is opposite to the surface that receives an image from the first image transfer means.

2. Image fixing apparatus according to claim 1, wherein said heat roll and said first pressure roll are each rotatable in two opposite directions so that said sheet of print-receiving material passes between said heat roll and said first pressure roll along said first line of contact, first in one direction by rotation of said heat roll and of said first pressure roll, then in a direction opposite to the first direction by rotation of said heat roll and of said first pressure roll.

3. Image apparatus according to claim 1, wherein said first surface of said sheet of print-receiving material faces a first direction when said sheet receives an image from said first image transfer means and said first surface of said sheet also faces in substantially the first direction when said sheet receives an image from said second image transfer means.

* * * * *